United States Patent [19]

Knippel

[11] 4,095,371

[45] Jun. 20, 1978

[54] OPERATING MECHANISM FOR BOX CAR SLIDING DOORS

[75] Inventor: Willis H. Knippel, Palos Park, Ill.

[73] Assignee: Pullman Incorporated, Chicago, Ill.

[21] Appl. No.: 825,346

[22] Filed: Aug. 17, 1977

[51] Int. Cl.[2] ..... E05F 11/00

[52] U.S. Cl. ..... 49/352; 49/220; 49/360

[58] Field of Search ..... 49/352, 360, 220, 218; 160/279, 277

[56] References Cited

U.S. PATENT DOCUMENTS

| | | | |
|---|---|---|---|
| 577,842 | 3/1897 | Davis | 49/279 |
| 2,841,390 | 7/1958 | Urquhart | 49/102 |
| 3,816,965 | 6/1974 | Nagy | 49/220 |
| 3,913,267 | 10/1975 | Knippel et al. | 49/360 X |
| 3,913,268 | 10/1975 | Paterson | 49/360 X |

*Primary Examiner*—Philip C. Kannan
*Attorney, Agent, or Firm*—Thomas G. Anderson

[57] ABSTRACT

A cable drive mechanism for opening and closing a sliding box car door includes a high friction drive pulley carrying a cable which is anchored at opposite ends to the sides of the box car and a low friction guide pulley which is in aligning relation to the drive pulley. The drive pulley is manually rotated for sliding the box car door between open and closed positions.

10 Claims, 10 Drawing Figures

FIG. 4
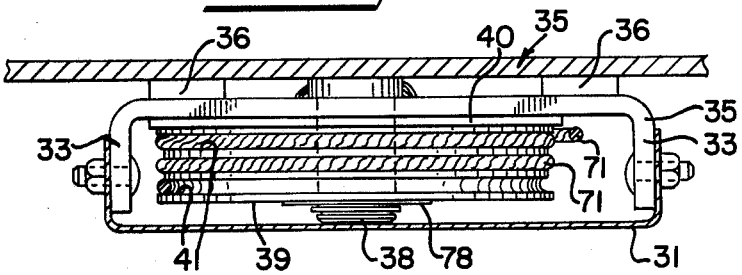
FIG. 5
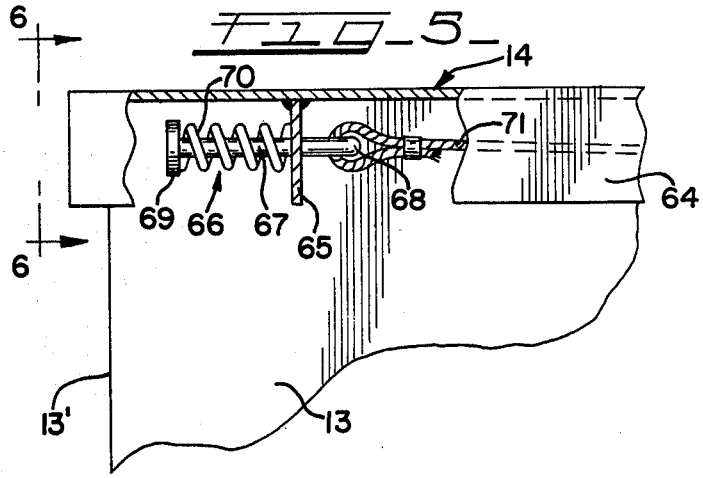
FIG. 6
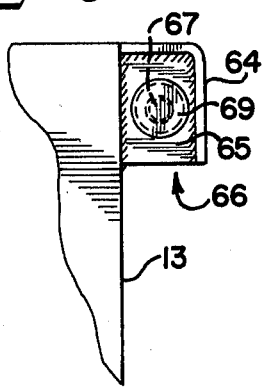
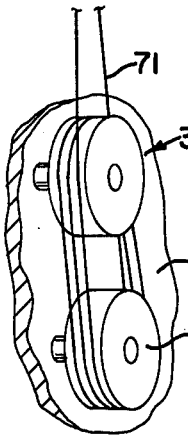
FIG. 7
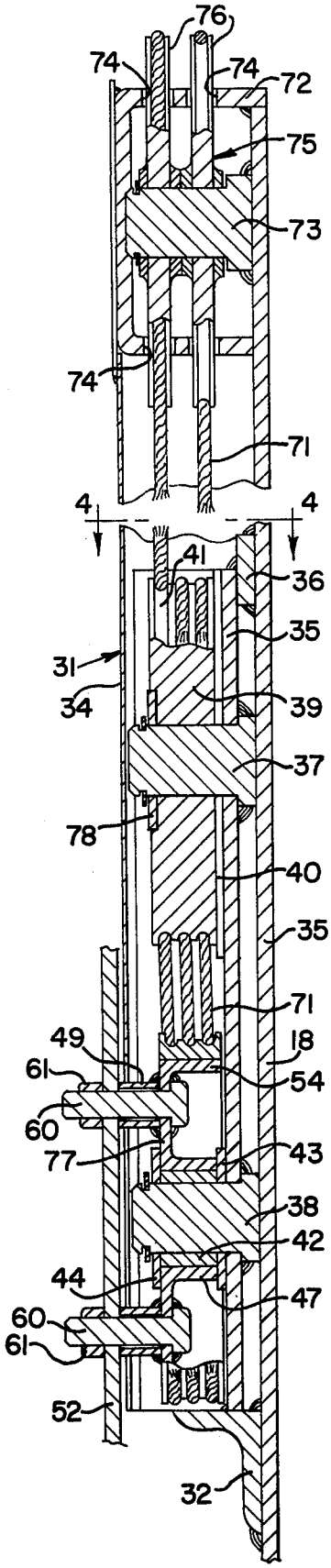
FIG. 3

OPERATING MECHANISM FOR BOX CAR SLIDING DOORS

BACKGROUND OF THE INVENTION

1. Field of the Invention

The present invention relates to sliding box car doors and specifically to the type of door which is manually power operated for sliding the door between open and closed positions.

2. Description of the Prior Art

The prior art is exemplified in U.S. Pat Nos. 1,503,500, Aug. 5, 1924; 233,658 Oct. 26, 1880; 2,841,390 July 1, 1958; 3,720,020 Mar. 13, 1973; 3,816,965 June 18, 1974; 3,913,267 Oct. 21, 1975 and 3,913,268 Oct. 21, 1975.

SUMMARY OF THE INVENTION

The present invention relates to a sliding box car door which is operated by a cable drive mechanism to slide the door between open and closed positions. Such cable mechanisms are shown in the aforementioned patents and operate in response to the manual manipulation of a hand wheel by an operator standing on the ground adjacent to the box car. In the present invention, as in the prior art, the cable ends are connected to opposite ends of the box car and are directed downwardly to a cable drive mechanism by means of idler pulleys supported on top of the sliding door. The manually operated drive mechanism of the present invention includes a hand wheel which is rotatably supported on the outer surface of the sliding door and which is connected to rotate a drive pulley contained within a door housing which also is in adjacent spaced relation to a guide pulley. The cable of the mechanism is wound about the guide pulley and drive pulley by a number of wraps so as to provide a means of steering the cable around the pulleys so that alignment and positive action of the cable is achieved. The present arrangement provides for a 5:1 ratio of mechanical advantage of the cable drive with respect to the door construction. The arrangement of the guide pulley and relationship to the drive pulley eliminates the possibility of the cable climbing on the drive pulley. This is one of the advantages over the prior art. Also, the guide pulley is made of a low friction polyethelene material whereas the drive pulley includes a high friction polyurethane material. This arrangement permits the cable to slip on the guide pulley without simultaneously slipping on the drive pulley. Therefore any slack between coils wrapped on the drive pulley will be automatically eliminated during the operation of the device. The feature insures uniform cable distribution on the drive pulley surface which similarly is an improvement in cable drive mechanisms.

BRIEF DESCRIPTION OF THE DRAWINGS

FIG. 3 is a cross-sectional view taken substantially along the line 3—3 of FIG. 2;

FIG. 4 is a cross-sectional view taken along the line 4—4 of FIG. 3;

FIG. 5 is a detailed view showing the connection of a cable end to the sides of a box car;

FIG. 6 is an end elevational view taken along the line 6—6 of FIG. 5;

FIG. 7 is a schematic view disclosing a pulley arrangement of the present invention;

DESCRIPTION OF THE PREFERRED EMBODIMENT

Figure 1:
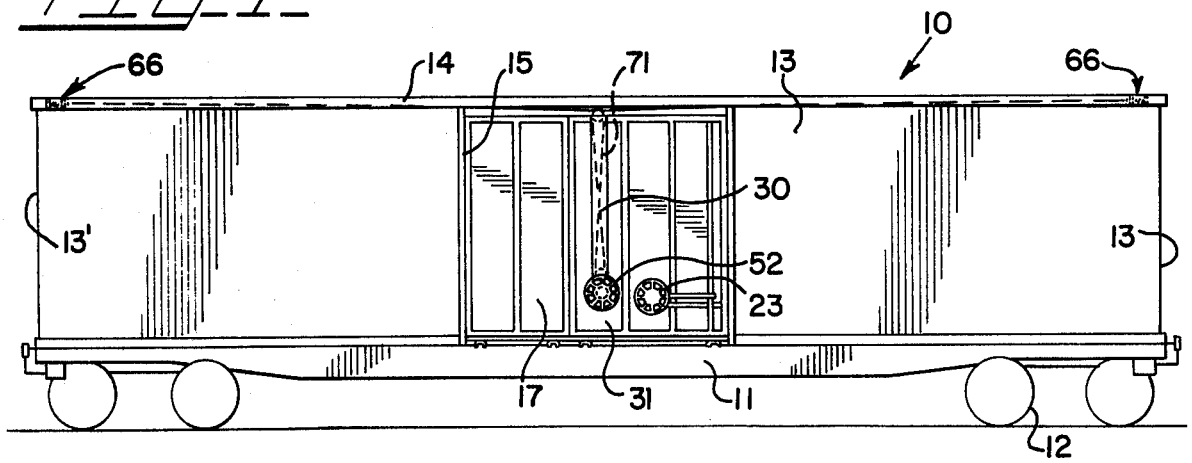
FIG. 1 is a side elevational view of a railway box car showing a sliding door arrangement.
Figure 2:
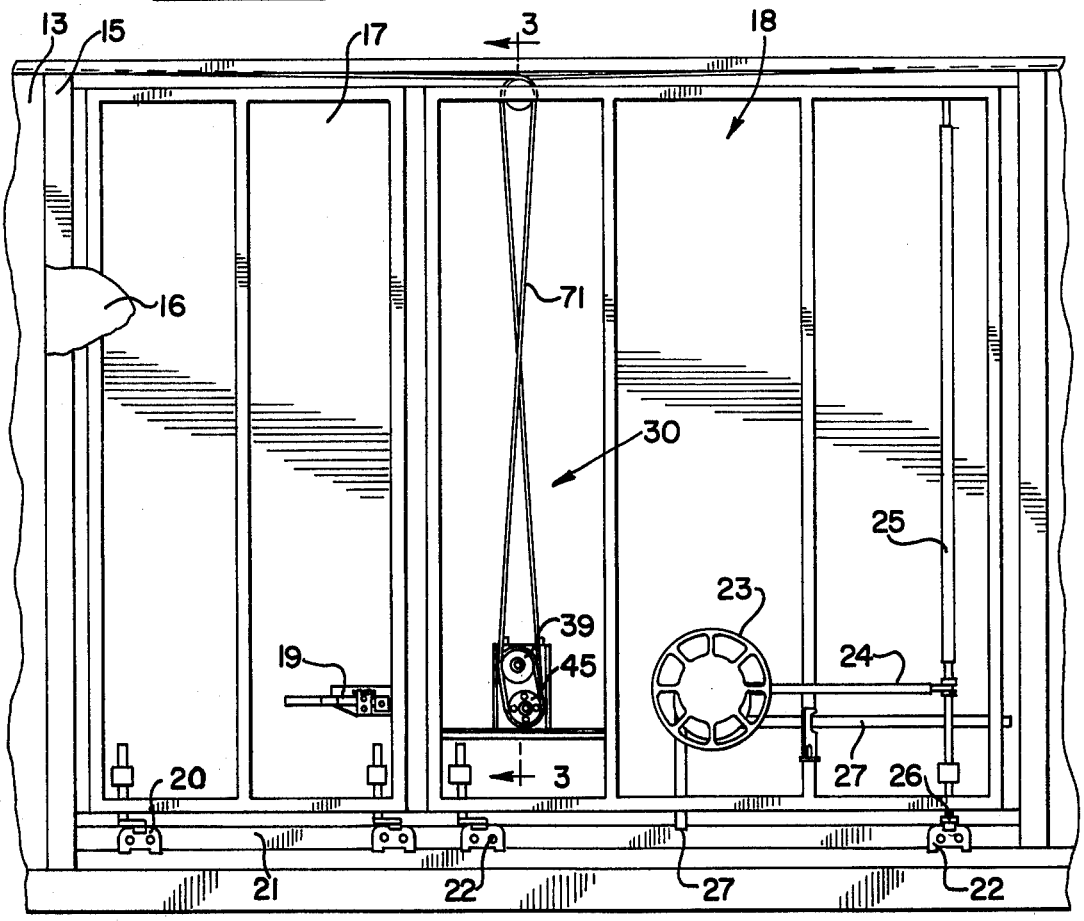
FIG. 2 is an enlarged side elevational view of a portion of the box car shown in FIG. 1 disclosing the sliding door.

FIGS. 1 and 2 disclose a railway car 10 comprising a conventional underframe 11, car trucks 12 and car sides 13. The car includes end walls 13' and a roof structure 14. A door opening frame 15 defines a door opening 16 which is closed by a first sliding door 17 and a second sliding door 18. The first sliding door 17 is a comparatively narrow door and includes an inter-engaging locking mechanism 19 which is adapted to interlock with the door 18 for movement therewith as desired. The door 17 also includes roller assemblies 20 which suitably support the door 17 for sliding arrangement on a track 21 suitably supported on the sides of the car below the door opening. The second sliding door 18 also is provided with similar roller assemblies 22 and includes a hand wheel 23 which operates a suitable linkage arrangement 24 for pivoting an operating rod 25 which by means of crank arms 26, one of which is shown, is supported on one of two roller assemblies 22 which provide for outward movement and relative sideway sliding movement of the door on the track 21. Locking bolts 27 are also actuated by the hand wheel 23 for locking the door assembly in a closed position. The operating arrangement for locking and moving the doors is more specifically disclosed in patents 3,816,965; 3,913,267 and 3,913,268.

A cable drive operating mechanism is generally designated at 30 and includes a U-shaped metal enclosure or housing section which is suitably connected to the side of the second door 18. The housing section 31 is supported at its lower end by means of a horizontally extending lower flange 32. The section 31 includes vertical side plates 33. A U-shaped housing section 35 includes a front vertical plate 34 which with the housing section 31 provides an enclosure within which the door operating mechanism 30 is positioned. The housing sections 31 and 35 are suitably supported on spacers 36 provided on the door 18. Pivot shafts 37 and 38 are also supported on the door 18 by means of the U-shaped section or plate 35 which is rigidly connected to the door 18. A guide pulley 39 is pivotally supported on the shaft 37 and is spaced from the plate section 35 by means of a spacer plate 40. The guide pulley 39 includes a plurality of circumferential grooves 41 and is rotatably supported on the shaft 37 and retained thereon by means of a retainer plate 78.

As best shown in FIG. 3 a drive pulley 54 is rotatably supported on the lower shaft 38. The drive pulley 54 includes a hub 47 in bearing relation to a spacer plate 43 positioned on the shaft 38. A retainer plate 44 secures the hub 47 for rotation on the shaft 38. The drive pulley 54 includes a cylindrical body plate 77 which supports a plurality of circumferentially disposed bolts 60 extending through spacers 49 and secure to a hand wheel 52 by means of a plurality of nuts 61.

As best shown in FIGS. 1, 5 and 6, cable connections 66 are provided at opposite ends of the box car adjacent to the roof ends thereof. Each cable connection includes a rod 67 which is slidably disposed in a bracket 65 secured to an outwardly and downwardly projecting portion of the roof 14 as indicated at 64. The rod 67 is provided with a spring retainer disc 69 which holds captive between the bracket and said disc a spring designated at 70. The end of the one end of the rod 67 is provided with a hook eye 68 to which a cable 71 is connected. The cable extends from the connections 66 inwardly and are wrapped on to the idler pulleys 76 which are freely journaled on a shaft 73 supported on the door 18. The upper end of the door is provided with a horizontal channel 72 providing a top beam for said door. The channel 72 is suitably apertured as indicated at 74 to provide for rotational clearance of the idler pulley arrangement 75. The pulleys 76 are freely journaled on the shaft 73 and the cable extends downwardly as indicated at FIG. 3 is wrapped around portions of the guide pulley 39 and is suitably wrapped about the drive pulley 54.

Figure 9:
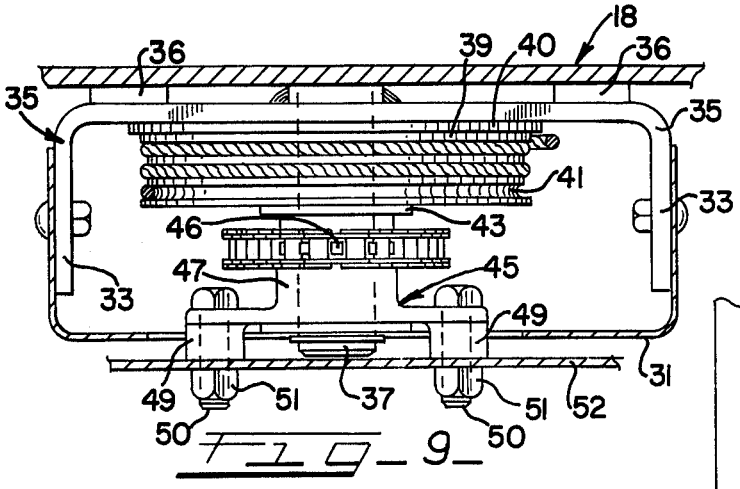
FIG. 9 is a cross-sectional view taken along the line 9—9 of FIG. 8.
Figure 10:
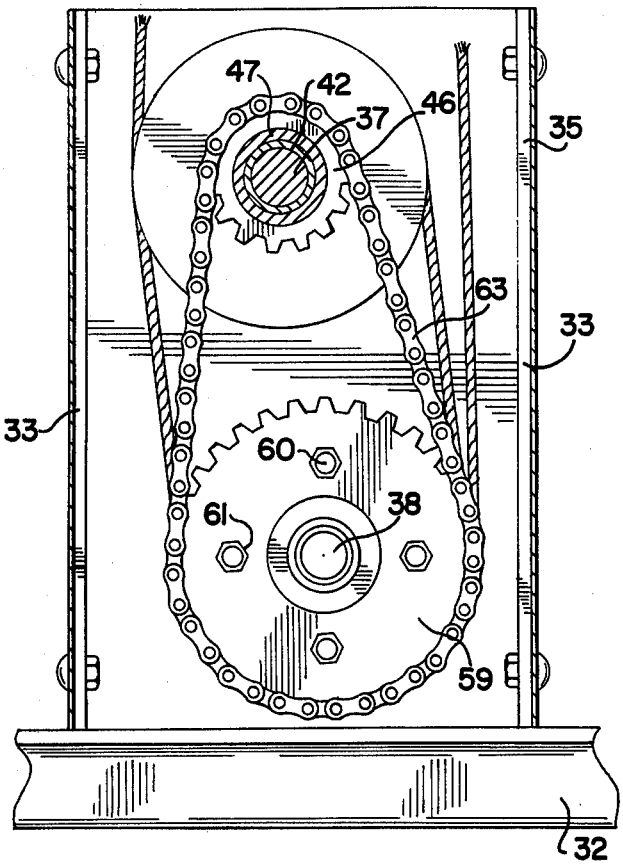
FIG. 10 is a cross-sectional view taken substantially along the line 10—10 of FIG. 8.
Figure 8:
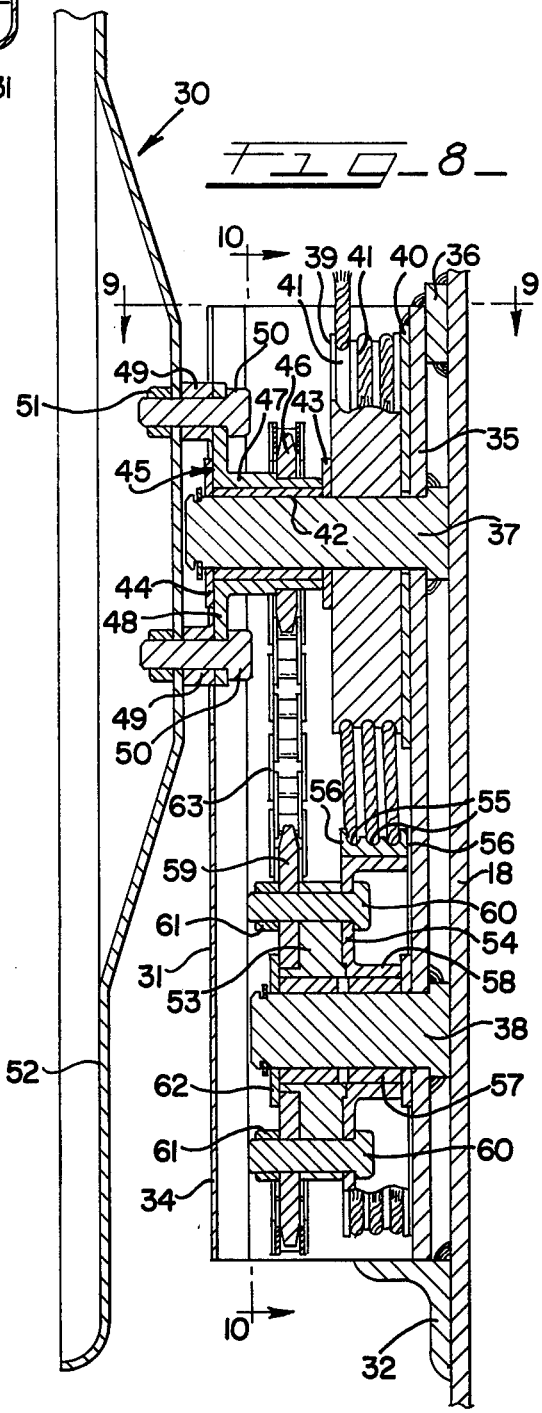
FIG. 8 is a cross-sectional view of another modified embodiment of the invention.

FIGS. 8, 9, and 10 disclose a modified form of the invention wherein the drive pulley is supported on the shaft 37 and thus is positioned on the same shaft that the idler pulley 39 is positioned. In FIG. 8 the shaft 37 is somewhat longer in length in order to support the hand wheel 52 and associated sprocket arrangement as will be described. The drive pulley 54 and associated parts of the embodiment shown in FIG. 8 is substantially similar to the arrangement shown in FIG. 5 and where the parts are substantially similar the same reference characters are applied. Referring to FIG. 8 the hand wheel 52 is supported by means of a bearing 42 on the shaft 37 and in turn supports the sprocket carrier 45. The sprocket 45 includes a hub 47 having supported thereon a sprocket 46 for rotating the same. The sprocket carrier 47 includes the hub 45 which is spaced from the guide pulley 39 by means of a spacer plate 43. A retaining plate 44 retains the sprocket carrier 45 on the shaft 37. The hand wheel 52 is secured to the sprocket carrier 45 by means of spacers 49 and bolts 50 and nuts 51. Thus rotation of the hand wheel provides for rotation of the sprocket while the guide pulley 39 can swivel freely in an idling manner with respect to the rotation of the hand wheel 52. The hub 47 is connected to a hub plate 48 of cylindrical shape to which the hand wheel 52 is connected as described before. In the latter arrangement the hand wheel 52 is disposed above the drive pulley 54 which is driven by means of the sprocket and chain arrangement 63 which is disclosed in FIG. 8.

OPERATION

The operation of the cable drive mechanism as shown in FIGS. 1, 2 and 3 is achieved when the door 18 alone or in unison with door 17 is to be moved laterally outwardly of the door opening to an open position. The power arrangement for moving the door requires the operator to turn the hand wheel 52 which rotates the drive pulley 54 in turn occasioning the winding of the cable on the guide pulley and idler pulleys to move the door laterally placing tension on one side of the cable and providing a slack on the other side of the cable. The movement of the cable thus is conventional in the prior art in response to the rotation of a suitable wheel and drive wheel arrangement. In the present instance the advantages of the invention are achieved in that the drive pulley is of a high friction type having been constructed of high friction polyurethane whereas the low friction guide pulley is constructed of a material known as polyethylene.

The guide wheel structure of the present invention thus in combination with the drive pulley provides for maximum contact between the cable and the surface of the drive pulley by eliminating the possibility of the cable climbing on itself. Since the magnitude of the frictional engagement force between the drive pulley and the cable is related to the extent of the pulley surface contacted by the cable this feature provides for an improved and more efficient cable driving mechanism.

Further by the utilization of the differential of high friction and low friction with respect to the associated pulleys the guide pulley allows the cable to slip on the guide pulley without simultaneously slipping on the drive pulley. Therefore any slack between the cable and the cable coils wrapped on the drive pulley will be automatically eliminated during operation of the device. This feature thus insures uniform cable load distribution on the drive pulley surface which similarly is an improvement in the cable drive mechanism. In the modification shown in FIGS. 8, 9 and 10, the hand wheel is positioned above and on the same shaft 37 as the guide pulley 39. In this connection, rather than a direct connection of the wheel to the drive pulley 54, the hub and sprocket carrier arrangement support the drive wheel and by means of a sprocket and chain arrangement the drive pulley 54 which is disposed below on a shaft 38 is rotated in operational manner. The advantages enumerated above with respect to the high friction and low friction of the drive pulley and guide pulley are the same and the rest of the advantages disclosed in the invention are available with both types of devices. It is to be noted that the grooves of the drive pulley and guide pulleys are concentric and that in each instance one of the pulleys is power driven. Further advantage in the drive pulley is provided by the outer enlarged peripherally extending and circumferential flanges 56 which also serve in the alignment and friction drive of the cable in winding of the cable on to cable turns on to each other. The cable movement is controlled therefore by friction between the drive and guide pulley grooves. The driving force which is achieved is dependent on the difference between tension in the tight and slack side. In order to avoid unequal tensions or differential actions between various wraps of cable the high friction polyurethene drive pulley with the low friction polyethylene guide pulley is provided. Additional advantages result that the grooved pulleys eliminate the crowding climbing action found in other types of sheave arrangements. A better slip clutch action is also obtained for positive overload protection under all conditions. The units also are adapted to fit within a relatively small space and thus are more easily installed and at a relatively more inexpensive cost.

What is claimed is:

1. For a railway car having a side door opening and a sliding door laterally movable from said opening to one side thereof, said door and car including releasable inter-engaging locking mechanisms, the improvement of a cable drive mechanism for opening and closing said door comprising;

a first drive pulley rotatably connected to said door, a second guide pulley rotatably connected to said door adjacent to said first pulley, a third idler pulley arrangement connected to said door for rotation above said first and second pulleys, said third pulley arrangement including a pair of circumferentially extending first grooves, a cable including means on one end for fixedly connecting the same to said car on one side of said door, said cable extending around one of said first grooves to said first and second pulleys and around the other of said first grooves of said third pulley arrangement, said cable including a second end extending from said third pulley arrangement and including second means fixedly connecting the same to said car on the other side of said door.

2. The invention in accordance with claim 1, said means fixedly connecting said cable ends including biasing means for maintaining tension on said cable ends.

3. The invention in accordance with claim 2, said tension means comprising springs.

4. The invention in accordance with claim 1, said first drive pulley being constructed and arranged to have a high coefficient of friction, and said second guide pulley arrangement having a low coefficient of friction.

5. The invention in accordance with claim 4, said first drive pulley comprising polyurethane and said second guide pulley comprising polyethelene.

6. The invention in accordance with claim 4, said first and second pulleys each having a plurality of circumferentially extending third and fourth grooves around which said cable extends.

7. The invention in accordance with claim 6, said grooves of said first and second pulleys being equal in number.

8. The invention in accordance with claim 1, said guide pulley being rotatably supported on said door by rigid shaft means, a sprocket on said shaft, hand wheel means connected to said sprocket to rotate the same, said drive pulley being supported on said door by second rigid shaft means, a second sprocket on said second shaft means connected to said drive pulley to rotate the same, and a drive chain connecting said sprockets.

9. The invention in accordance with claim 8, said guide pulley being vertically positioned above said drive pulley.

10. The invention in accordance with claim 8, said drive pulley and guide pulleys each comprising a plurality of grooves and said drive pulley having enlarged outer peripherally and circumferentially extending flanges.

* * * * *